US006623285B2

(12) United States Patent
Nishide

(10) Patent No.: US 6,623,285 B2
(45) Date of Patent: Sep. 23, 2003

(54) LEVER-TYPE CONNECTOR WITH CONNECTION TESTING FEATURES

(75) Inventor: Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/139,838

(22) Filed: May 6, 2002

(65) Prior Publication Data

US 2003/0008537 A1 Jan. 9, 2003

(30) Foreign Application Priority Data

Jul. 5, 2001 (JP) ..... 2001-136473

(51) Int. Cl.[7] ..... H01R 13/44; H01R 13/62
(52) U.S. Cl. ..... 439/140; 439/157
(58) Field of Search ..... 439/140, 141, 439/157, 912

(56) References Cited

U.S. PATENT DOCUMENTS 5,269,696 A * 12/1993 Okada et al. ..... 439/140
6,095,833 A 8/2000 Osawa
6,146,161 A * 11/2000 Osawa ..... 439/140
6,193,531 B1 * 2/2001 Ito et al. ..... 439/140

* cited by examiner

*Primary Examiner*—Gary Paumen
(74) *Attorney, Agent, or Firm*—Anthony J. Casella; Gerald E. Hespos

(57) ABSTRACT

A connector has a male housing (20) with a receptacle (23) and male terminal fittings (10) with tabs (12) whose leading end positions that differ with respect to a connecting direction. A lever (33) is rotatably supported on the male housing (20), and a moving plate (28) for supporting the tabs (12) of male terminal fittings (10) is mounted into the receptacle (23). The lever (33) can be rotated in a first direction to a testing position and pulls the moving plate 28 sufficiently into the receptacle (23) for all the tabs (12) to project beyond the moving plate and toward the opening side of the receptacle (23) for testing.

9 Claims, 8 Drawing Sheets

LEVER-TYPE CONNECTOR WITH CONNECTION TESTING FEATURES

BACKGROUND OF THE INVENTION

1. Field of the Invention

The present invention relates to a lever-type connector.

2. Description of the Related Art

A known lever-type connector is disclosed in U.S. Pat. No. 5,269,696. This known lever-type connector has a male housing with a receptacle and a lever mounted on the male housing. The lever has cam grooves formed therein. A moving plate is movably disposed in the receptacle for positioning male tabs of male terminals, and a female terminal can be fit in the receptacle after the moving plate. The female terminal and the moving plate are formed with cam pins that can engage the cam grooves of the lever.

The lever can be set at a connection starting position, so that the cam pins of the female housing and the moving plate engage with cam grooves in the lever. The lever can be rotated to a connection position so that the cam grooves and the cam pins pull the female housing and the moving plate into the receptacle, thereby connecting the male and female housings.

It may be necessary to perform an electrical connection test for the male terminals before the female housing is connected with the male housing. Thus, a testing device is inserted into the receptacle from the front with the lever set at the connection starting position. The testing device then is brought into contact with the leading ends of the tabs that project forward from the moving plate.

There are some cases where the male housing of the lever-type connector has male terminals with tabs of different lengths, and relatively short tabs cannot project forward from the moving plate when the lever is at the connection starting position. In such a case, the electrical connection test is conducted with the lever rotated part of the way toward the connection ending position to pull the moving plate. However, operability is poor because it is difficult to determine the degree of rotation of the lever that will cause the tabs to project. Further, if the lever is rotated completely to the connection ending position, the rotation stroke is too large and operability is unsatisfactory.

In view of the above, it may be considered to reset the moving plate in a height direction to a lower position that conforms to the shortest tab. However, this is not a fundamental solution because the relatively long tabs may not be positioned properly.

The present invention was developed in view of the above situation and an object thereof is to improve the operability by allowing an electrical connection test for a plurality of male terminal fittings in particular having tabs whose leading ending positions differ with respect to a connecting direction.

SUMMARY OF THE INVENTION

The invention is directed to a lever-type connector with a first housing that has a receptacle and a second housing that can be fit into the receptacle. The first housing has a plurality of terminal fittings with tabs that project into the receptacle. A moving plate is disposed in the receptacle for movement along a connecting direction, and the tabs of the terminal fittings can be arranged in or through the moving plate. A cam pin projects from the moving plate and a lever with a cam groove is pivotally mounted on the first housing. The cam groove of the lever can engage the cam pins when the lever is in the connection starting position. The lever then can be pivoted toward the connection ending position to pull the second housing and the moving plate into the receptacle. The lever also can be pivoted to a testing position before the housings are connected. Rotation of the lever to the testing position pulls the moving plate to a position where the tabs of all terminal fittings project from the moving plate and toward an open side of the receptacle with the cam pin of the moving plate held engaged with the cam groove. Thus, a testing device can be inserted into the receptacle and into contact with the projecting portions of the tabs.

The second housing may have a cam pin that engages a cam groove of the lever. The cam pin of the second housing may be unitable with the cam pin of the movable plate and fitted into the same cam groove on the lever.

The connector preferably comprises lock means for holding the lever at the testing position.

The terminal fittings may have tabs with leading ends at different with respect to a connecting direction. The electrical connection test can be performed simultaneously even though the male terminal fittings have tabs with leading ends at different positions along the connecting direction. The lever is returned to the connection starting position after the electrical connection test is completed, and then the housings can be connected with each other.

The lever preferably reaches the testing position by rotation from the connection starting position in a direction opposite from the connection ending position. Additionally, the cam groove has an engaging area that engages the cam pin of the moving plate when the lever is rotated to the testing position.

The rotating direction of the lever can be reversed at the time of the electrical connection test and at the time of the connecting operation. In contrast, if the testing position were at an intermediate position between the connection starting position and the connection ending position, the lever would be at the testing position during the rotation course of the lever when the two housings are being connected. Thus, the lever could not be rotated continuously, and operability would be reduced. However, the operability of the lever is satisfactory according to the present invention.

The lever preferably is spaced from and does not overlap the opening side of the receptacle when the lever is at the testing position. Thus, the lever does not hinder the insertion of the testing device through the opening side of the receptacle when the electrical connection test is to be conducted.

The lever preferably abuts on a receiving portion of the first housing in the testing position.

Further, the lever preferably overlies the opening side of the receptacle when the lever reaches the connection ending position.

The movable plate may comprise positioning holes for guiding insertion of the terminal fittings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
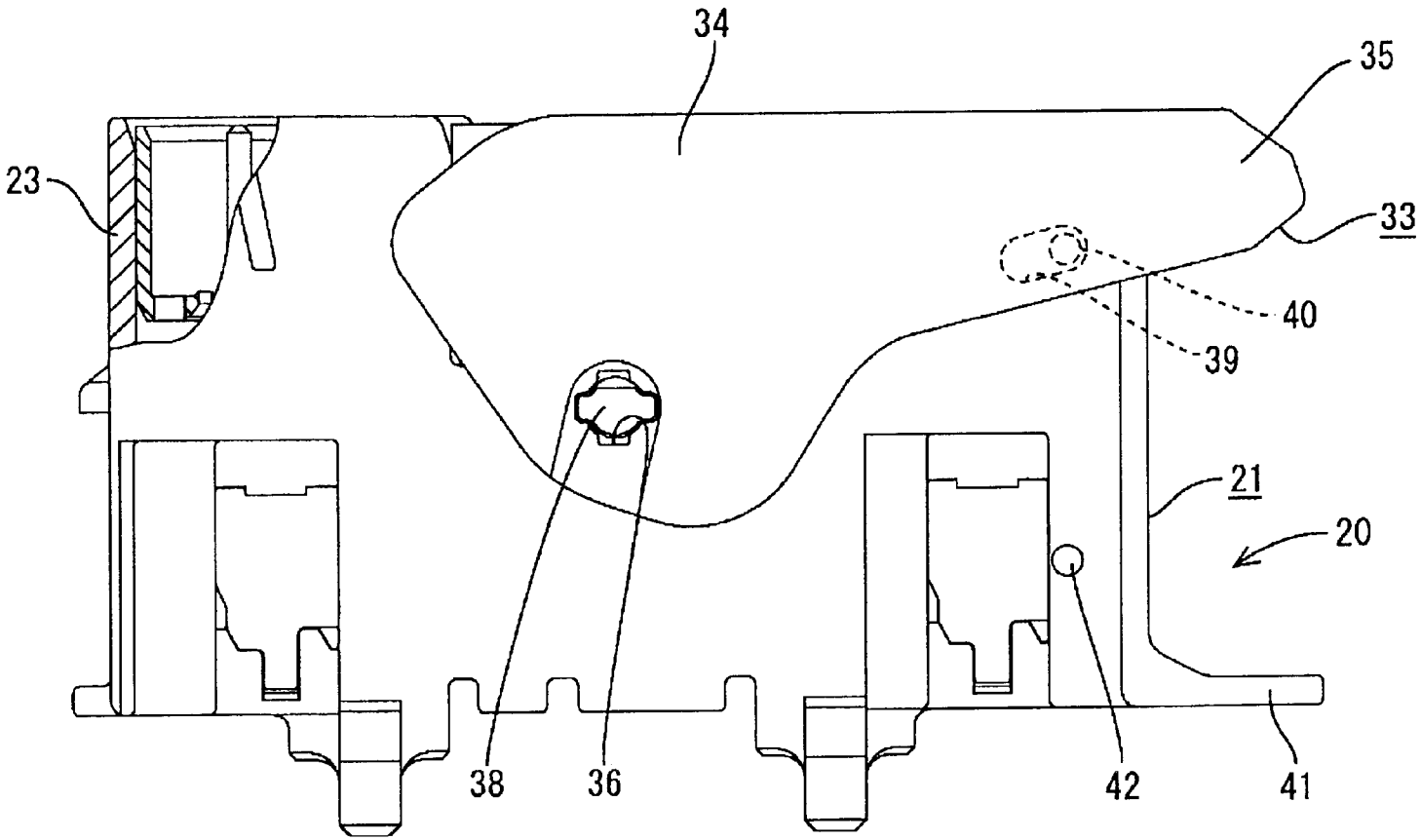
FIG. 1 is a side view of a male housing according to one embodiment of the present invention with a lever held at a connection starting position.

A lever-type connector according to the invention has a male housing 20 and a female housing 50, as shown in FIGS. 1–8. The male and female housings 20, 50 are connectable with each other along a connecting direction CD. Male terminal fittings of three different sizes are accommodated in the male housing 20. In the following description, the male terminal fittings and the tabs thereof are identified by reference numerals 10, 12 when identified collectively, whereas suffixes A, B, C follow the reference numerals 10, 12 when they are identified individually.

Figure 2:
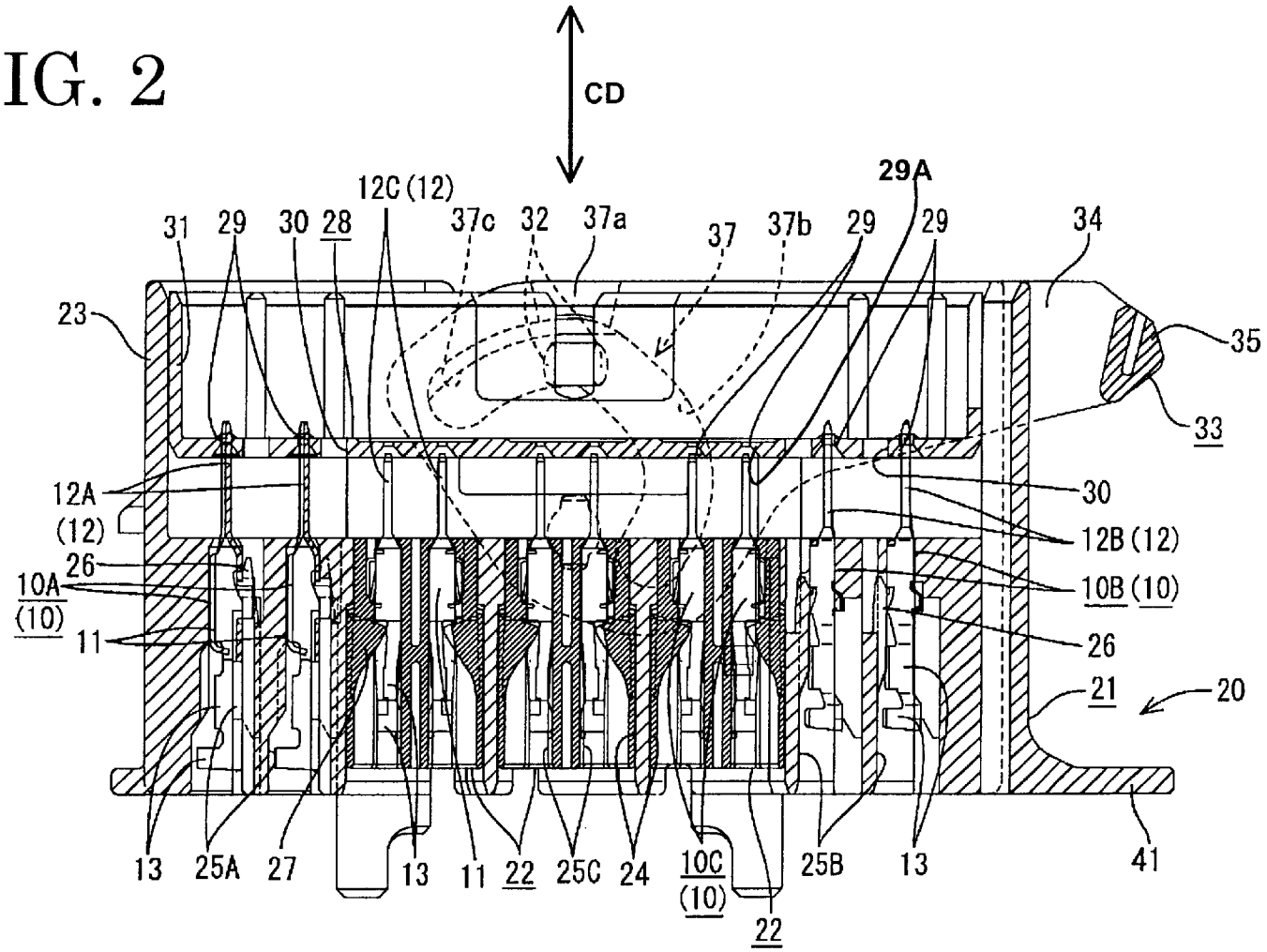
FIG. 2 is a side view in section of the male housing with the lever held at the connection starting position.

As shown in FIG. 2, each male terminal fitting 10 has a box-shaped main body 11 and a tab 12 in the form of a substantially flat plate that projects up in FIG. 2 from the main body 13. The tab 12 can be connected electrically with a mating female terminal fitting (not shown). A barrel 13 projects down from the main body 11 and can be crimped into connection with a wire (not shown). The tabs 12A of the large male terminal fittings 10A and the tabs 12B of the medium male terminal fittings 10B have substantially the same length, but have different widths (see FIG. 5). The tabs 12C of the small male terminal fittings 10C are shorter and narrower than the tabs 12A, 12B of the large and medium male terminal fittings 10A, 10B.

Figure 5:
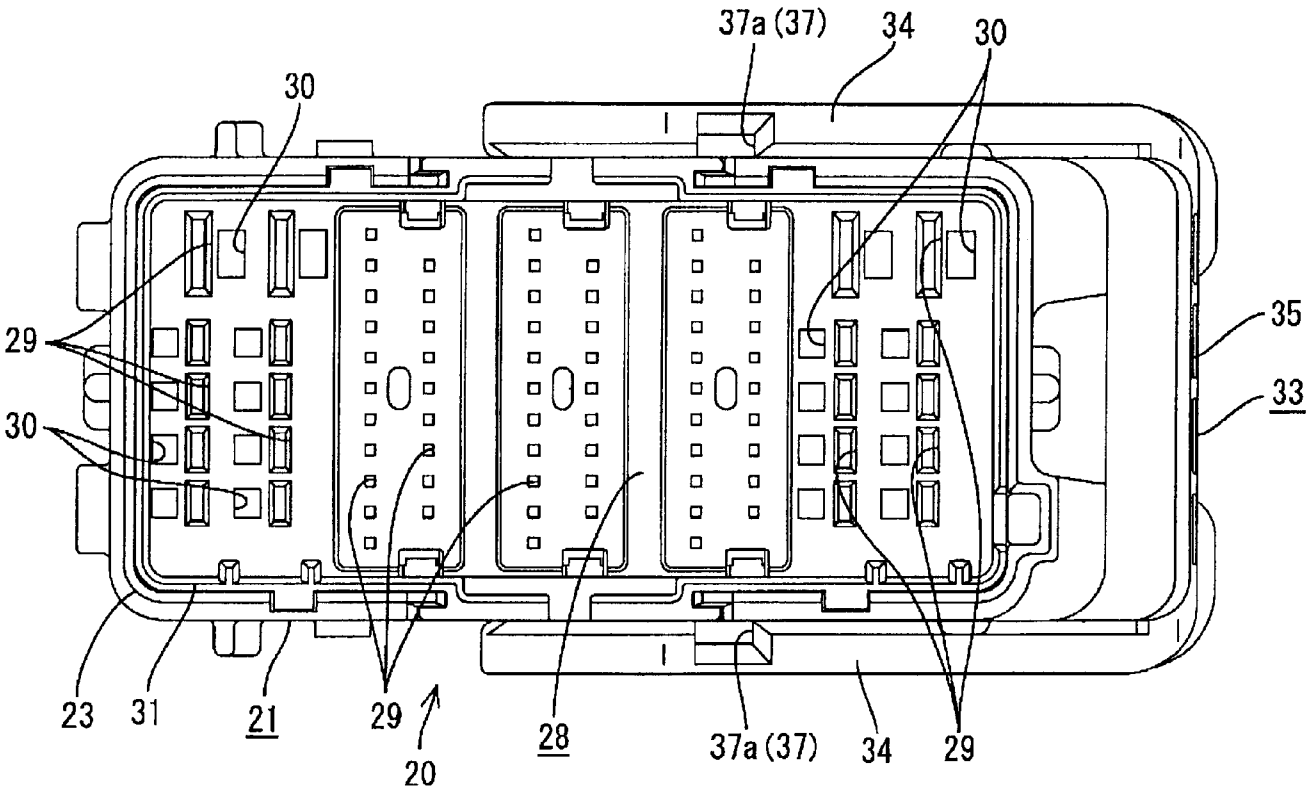
FIG. 5 is a front view of the male housing with the lever held at the testing position.

The male housing 20 has a main body 21 with a substantially rectangular tubular receptacle 23 that projects up. Three auxiliary housings 22 are accommodated in the housing main body 21. As shown in FIGS. 2 and 5, three auxiliary housing accommodating chambers 24 are formed substantially side by side at a middle part of the main body 21 with their longitudinal directions aligned vertically in FIG. 5 along the connecting direction CD. Two large cavities 25A are formed substantially side-by-side at each of the opposite sides of the main body 21, and the large male terminal fittings 10A are insertable into the large cavities 25A. Four medium cavities 25B are aligned substantially vertically in FIG. 5 along the connecting direction CD at substantially the same positions as the large cavities 25A with respect to the transverse direction of FIG. 5. Thus, a total of 16 medium cavities 25B are formed, and the medium-size male terminal fittings 10B are insertable into the medium cavities 25B. The large and medium male terminal fittings 10A, 10B are held in the respective cavities 25A, 25B by locks 26, and the tabs 12A, 12B thereof project into the receptacle 23, as shown in FIG. 2. The leading ends of the tabs 12A of the large male terminal fittings 10A and the leading ends of the tabs 12B of the medium male terminal fittings 10B are at substantially the same height position.

Each auxiliary housing 22 is substantially block-shaped, and is formed internally with nine small cavities in the left row and 11 small cavities in the right row in FIG. 5. Thus, twenty small cavities 25C are provided for receiving the small male terminal fittings 10C. Of course, more or fewer small cavities 25C and small male terminal fittings 10C may be provided. The small male terminal fittings 10C are inserted into the small cavities 25C to a proper insertion depth, and then are held by locks 27, as shown in FIG. 2, so as not to come out. Similarly, each auxiliary housing 22 is inserted into the corresponding auxiliary housing accommodating chamber 25 from below in FIG. 2 to a proper insertion depth, and then is held by an unillustrated holding means so as not to come out. At this stage, the tabs 12C of the small male terminal fittings 10C project into the receptacle 23, and the leading ends of the tabs 12C with respect to the connecting direction CD are lower than the leading ends of the tabs 12A, 12B of the large and medium male terminal fittings 10A, 10B. Thus, the small tabs 12C project a shorter distance into the receptacle 23 than the medium tabs 12B and the large tabs 12A.

Figure 6:
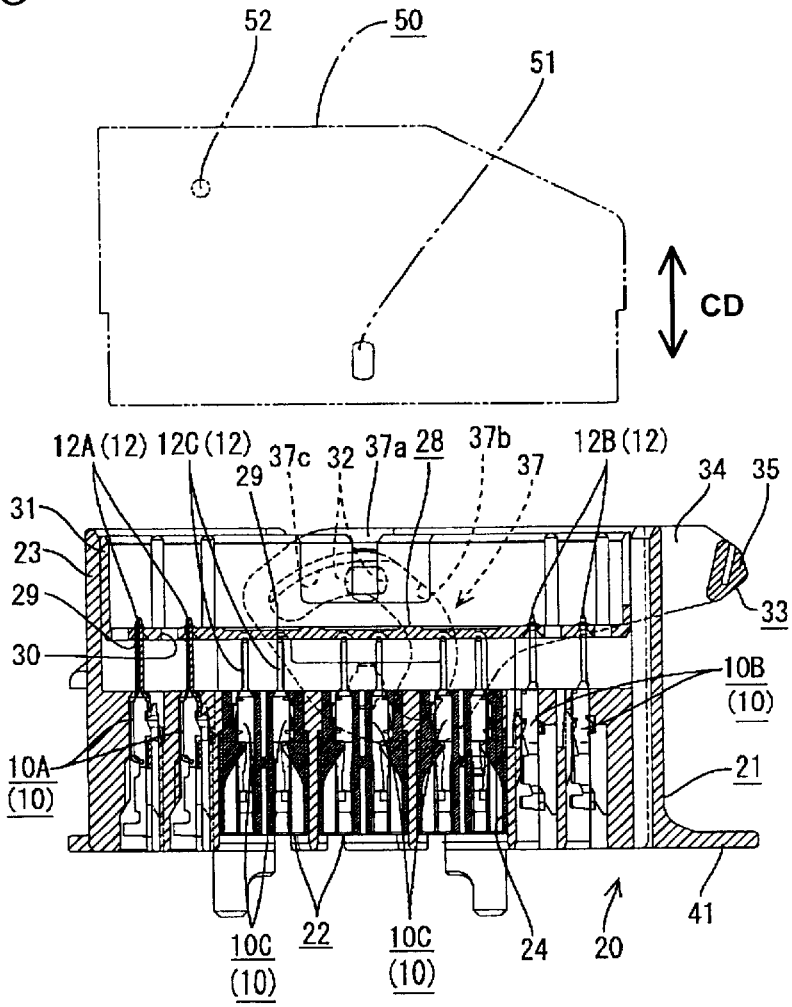
FIG. 6 is a side view in section showing a state before two housings are connected with each other.

A moving plate 28 is mounted into an opening side of the receptacle 23 for vertical movement substantially along the connecting direction CD, as shown in FIG. 2. The moving plate 28 is formed with positioning holes 29 for receiving and supporting the tabs 12 of the respective male terminal fittings 10. The respective positioning holes 29 have sizes and positions substantially conforming to the tabs 12 of the corresponding male terminal fittings 10, and the edges 29A of the positioning holes 29 on the side of the moving plate 28 facing toward the cavities 25A–C are beveled to guide the insertion of the tabs 12. Further, the upper surface of the moving plate 28 is recessed at portions corresponding to the auxiliary housings 22, and a plurality of unlocking holes 30 are formed at positions conforming to the locks 26 of the large and medium cavities 25A, 25B. A tubular guide wall 31 projects at the outer periphery of the moving plate 28. The guide wall 31 can slide against the inner surface of the receptacle 23 and thus enables a constant posture for the moving plate 28. Cam pins 32 project from the outer surface of each shorter side of the guide wall 31. The cam pins 32 are cylindrical, but have a middle section cut away. On the other hand, the female housing 50 has a substantially block shape and is dimensioned to fit into the receptacle 23, as shown in FIG. 6. Cam pins 51 project from the opposite sides of the female housing 50 and fit into clearance between each pair of cam pins 32 of the moving plate 28.

Figure 3:
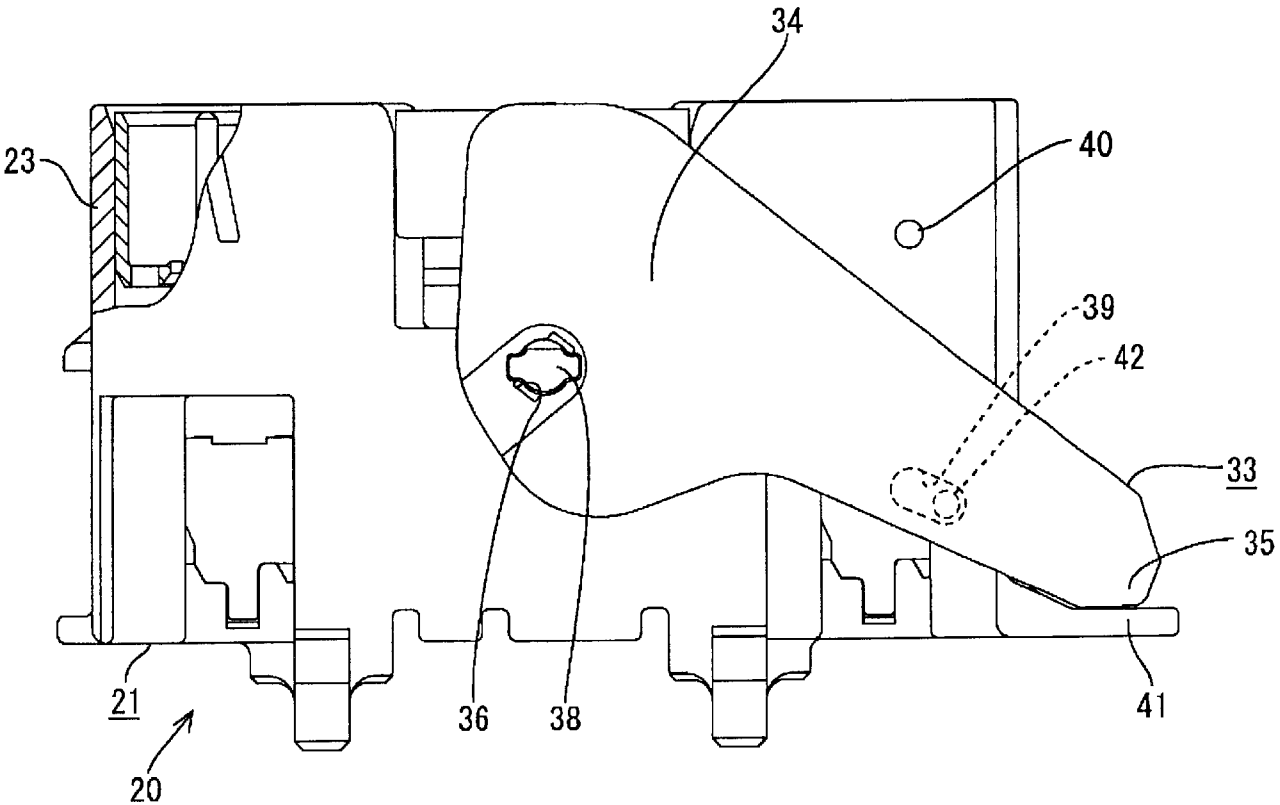
FIG. 3 is a side view of the male housing with the lever held at a testing position.

A lever 33 is formed by connecting the leading ends of two substantially plate-shaped arms 34 by an operable portion 35, as shown in FIGS. 1 and 5. Bearing holes 36 are formed at base-ends of the arms 34 and cam grooves 37 surrounding the bearing holes 36. This lever 33 is supported rotatably by engaging the bearing holes 36 with supporting shafts 38 that project from the outer sides of the housing main body 21. The lever 33 can be rotated counterclockwise from the connection starting position of FIG. 1 to the connection ending position shown in FIG. 8. Alternatively, the lever 33 can be rotated clockwise from the connection starting position shown in FIG. 1 to a testing position, as shown in FIG. 3. In other words, the lever 33 is rotated in a first direction from the connection starting position (FIGS. 1; 6; 7) to reach the connection end position (FIG. 8), and is rotated in an opposed direction to reach the testing position (FIGS. 3; 4).

The operable portion 35 of the lever 33 is at the side of the receptacle 23 and entrances 37*a* of the cam grooves 37 face up toward the receptacle 23 when the lever 33 is at the connection starting position shown in FIG. 2. The cam pins 32, 51 then are moved along the connection direction CD and enter the cam grooves 37 from above or from a mating side of the male connector with the female connector. The initial insertion of cam pins 32 into the cam grooves 37 holds the moving plate 28 at a specified position along the connecting direction CD. Specifically, at this first position, the tabs 12A, 12B of the large and medium male terminal fittings 10A, 10B are guided by the beveled edges 29A into the positioning holes 29 and project up from the upper surface of the moving plate 28. However the tabs 12C of the small terminal fittings 10C do not project up from the upper surface of the moving plate 28 and still have their leading ends in the positioning holes 29. As shown in FIG. 1, a locking recess 39 is formed in the inner surface of each arm 34, and the lever 33 is held so as not to move loosely from the connection starting position by the engagement of the locking recesses 39 with starting position locks 40 that project from the outer sides of the housing main body 21.

Figure 7:
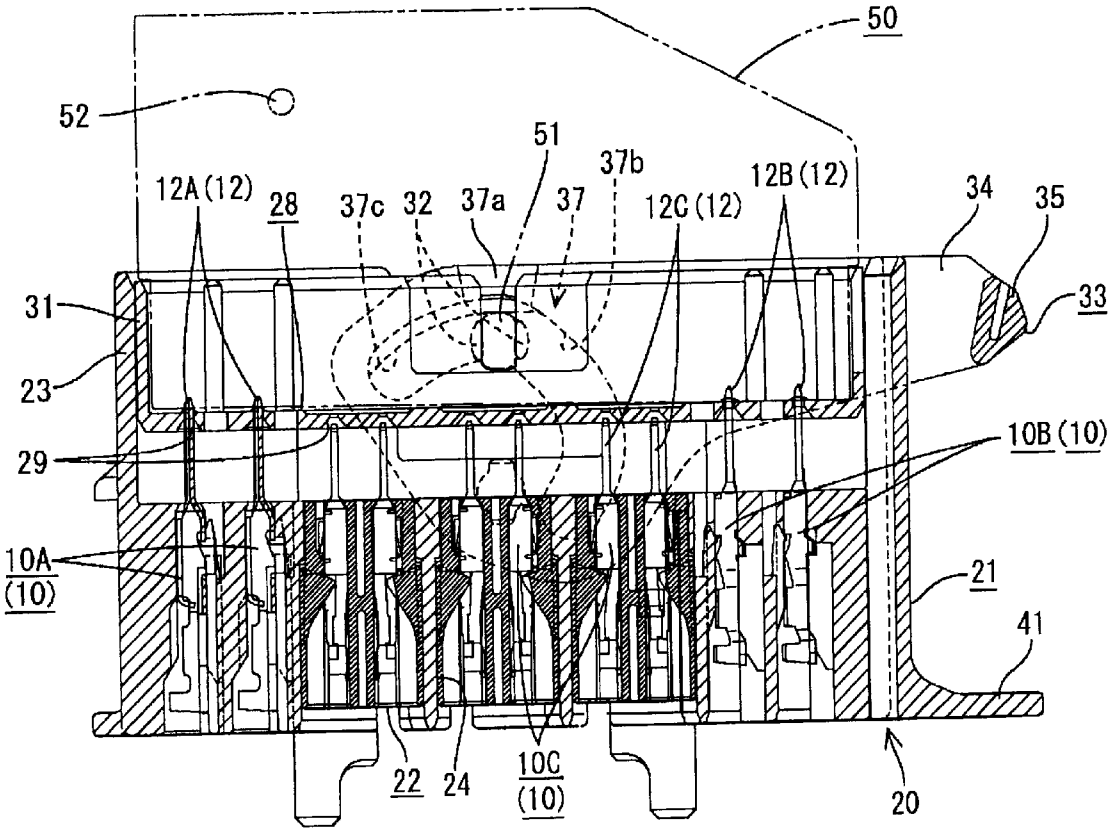
FIG. 7 is a side view in section showing a state where the connection of the two housings is started.
Figure 8:
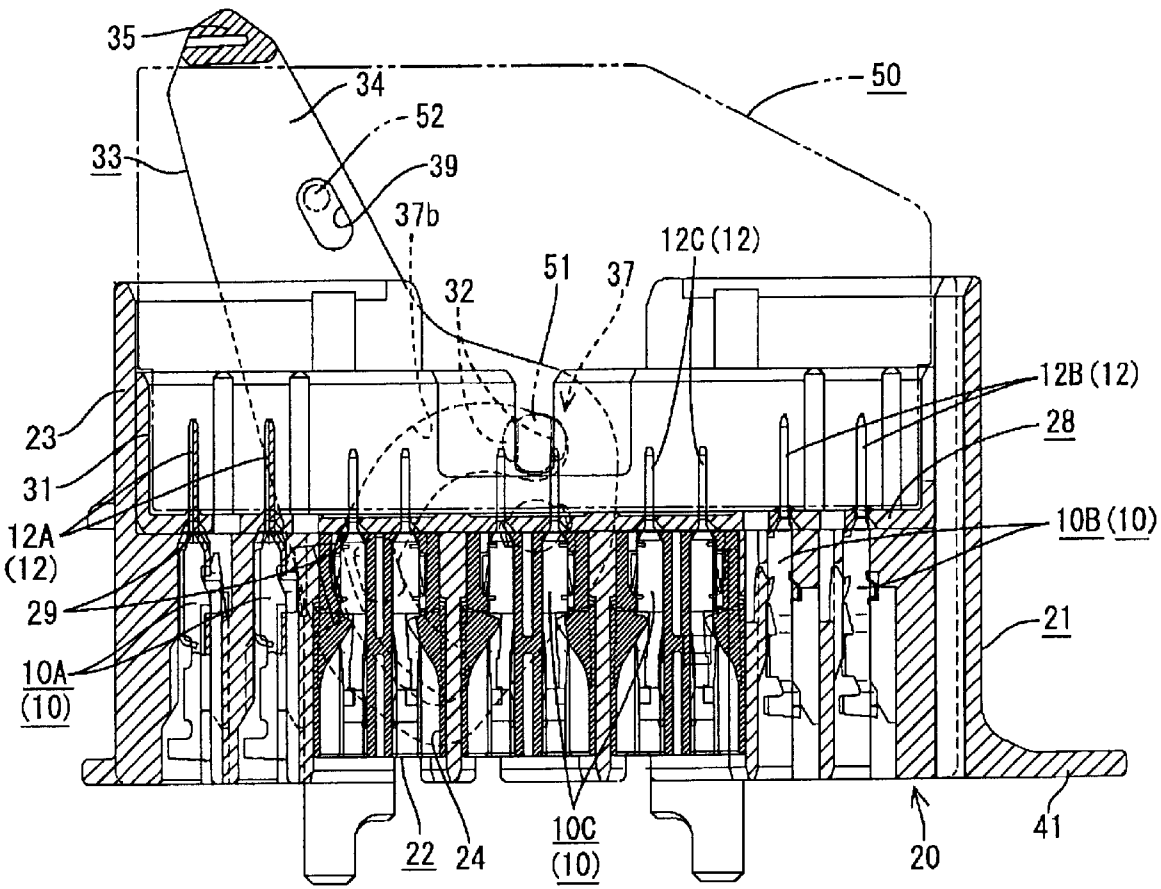
FIG. 8 is a side view in section showing a state where the connection of the two housings is completed.

The cam grooves 37 have spiral-shaped engaging areas 37*b* that engage the corresponding cam pins 32, 51 when the lever 33 is rotated from the connection starting position (FIG. 1) to the connection ending position (FIG. 8). Each spiral-shaped engaging area 37*b* gradually approaches the corresponding bearing hole 36, as shown in FIG. 7 and when seen in an azimuthal direction around the bearing hole 36. Rotation of the lever 33 from the connection starting position (FIG. 1) to the connection ending position (FIG. 8) pulls the female housing 50 and the moving plate 28 into the receptacle 23 due to engagement of the engaging area 37*b* and the cam pins 32, 51. The housings 20, 50 are connected properly, as shown in FIG. 8, when the lever 33 reaches the connection ending position. At the connection ending position, the locking recesses 39 engage with locks 52 that project from the sides of the female housing 50 to hold the lever 33 in the connection ending position.

Figure 4:
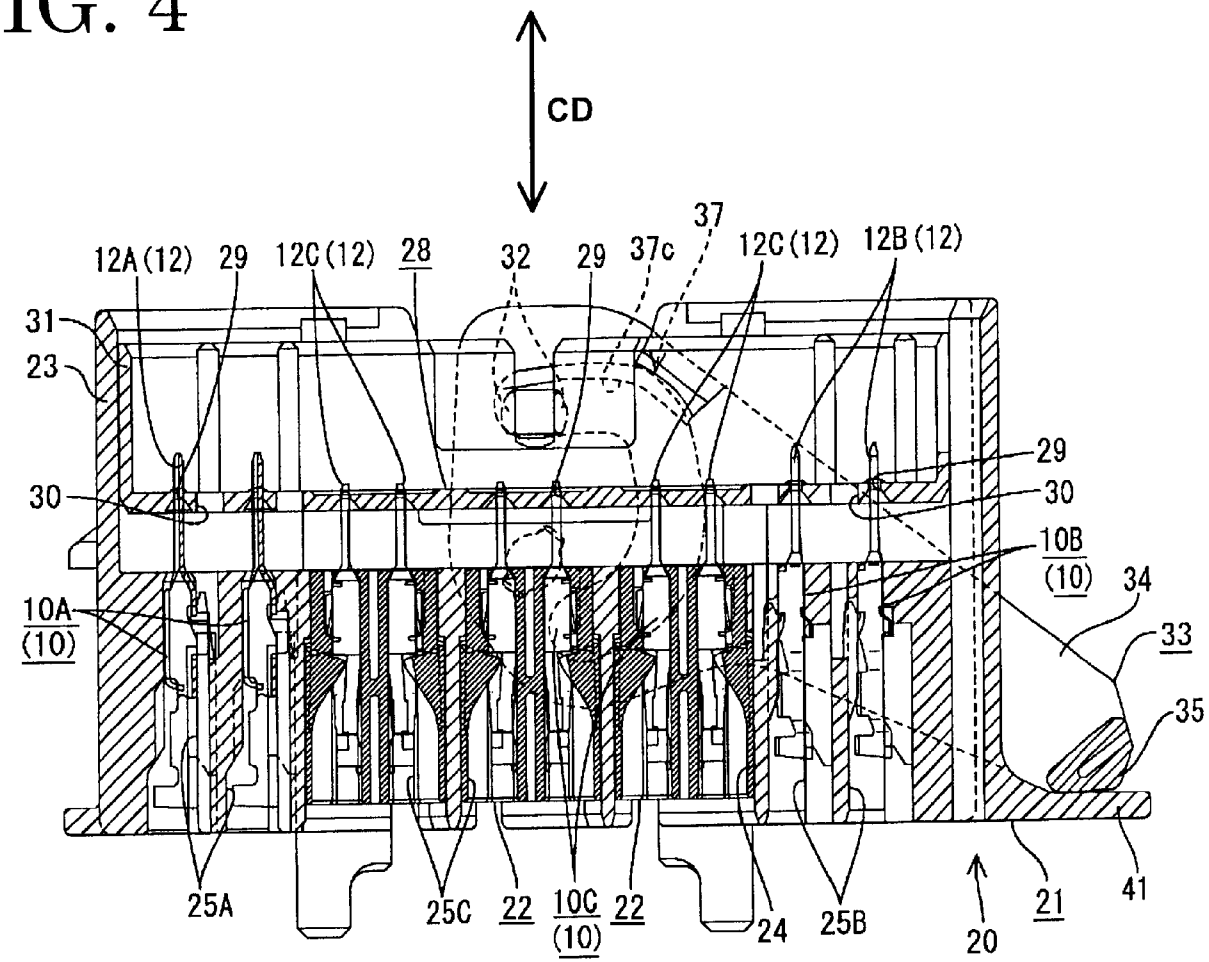
FIG. 4 is a side view in section of the male housing with the lever held at the testing position.

Each cam groove 37 has a substantially spiral-shaped engaging area 37*c* that engages the cam pins 32 when the lever 33 is rotated from the connection starting position (FIG. 1) to the testing position (FIG. 3). The spiral-shaped engaging area 37*c* for testing gradually approaches the corresponding bearing hole 36 as shown in FIG. 2 when seen in the azimuthal direction around the bearing hole 36. The engaging area 37*c* is curved more moderately than the engaging area 37*b* and is about half as long as the engaging area 37*b*. Rotation of the lever 33 from the connection starting position to the testing position, causes the engaging area 37*c* to engage the cam pins 32 and pull the moving plate 28 along the connection direction CD to a specified position with respect to the receptacle 23, as shown in FIG. 4. At this second relative position, the tabs 12A, 12B of the large and medium male terminal fittings 10A, 10B continue to project up beyond the upper surface of the moving plate 28, whereas the tabs 12C of the small male terminal fittings 10C pass the positioning holes 29 and project up beyond the upper surface of the moving plate 28. Thus, the tabs 12 of all the male terminal fittings 10 project up from the upper surface of the moving plate 28 and are exposed to the opening side of the receptacle 23. At this testing position, the operable portion 35 of the lever 33 engages a receiving portion 41 that projects transversely from the side edge of the bottom end of the housing main body 21 at a position distant from the opening of the receptacle 23. Additionally, the locking recesses 39 of the arms 34 engage locks 42 that project from the outer side surfaces of the housing main body 21, as shown in FIG. 3, to prevent the lever 33 from moving loosely from the testing position.

The male housing 20 is assembled at a factory by first mounting the lever 33 at the connection starting position on the housing main body 21, and then mounting the moving plate 28 into the receptacle 23 so that the cam pins 32 enter the cam grooves 37 through the entrances 37*a*. The large and medium male terminal fittings 10A, 10B then are inserted into the large and medium cavities 25A, 25B from below, as shown in FIG. 2, and the auxiliary housings 22 that accommodate the small male terminal fittings 10C in the small cavities 25C are inserted into the auxiliary housing accommodating chambers 24 from below. The tabs 12A, 12B of the large and medium male terminal fittings 10A, 10B are inserted through the positioning holes 29 of the moving plate 28 to project up from the moving plate 28, whereas the leading ends of the tabs 12C of the small male terminal fittings 10A do not pass through the positioning holes 29.

The lever 33 then is rotated to the testing position (FIGS. 3, 4) to conduct the electrical connection test for the respective male terminal fittings 10 in the male housing 20. The engagement of the cam pins 32 with the engaging area 37*c* of the cam grooves 37 pulls the moving plate 28 into the receptacle 23. A projecting amount of the tabs 12A, 12B of the large and medium male terminal fittings 10A, 10B from the upper surface of the moving plate 28 increases as the moving plate 28 is displaced. Simultaneously, the tabs 12C of the small male terminal fittings 10C are guided through the positioning holes 29 by the beveled edges 29*a* and gradually project from the upper surface of the moving plate 28. When the lever 33 reaches the testing position, the tabs 12 of all of the male terminal fittings 10 project from the upper surface of the moving plate 28 and are exposed to the opening side of the moving plate 28 as shown in FIG. 4. At this time, the operable portion 35 engages the receiving portion 41 to prevent further rotation of the lever 33, and the locks 42 engage the locking recesses 39 as shown in FIG. 3, to hold the lever 33 at the testing position.

The electrical connection test can be conducted for the male terminal fittings 10 with the lever 33 held at the testing position. More particularly, an unillustrated testing device can be inserted into the receptacle 23 from above the male housing 20 and can be brought into contact with the tabs 12 of the respective male terminal fittings 10 that project from the moving plate 28. At this time, the operable portion 35 of the lever 33 is held at the testing position at the side of the receptacle 23 distant from the opening side of the receptacle 23. Thus, the testing device can be inserted easily.

Upon completion of the electrical connection test, the male housing 20 is shipped to an assembling site with the lever 33 held at the testing position and engaged with the receiving portion 41. Thus, the receiving portion 41 receives a pushing force that may be exerted inadvertently on the operable portion 35 or the receiving portion 41 during shipping and no excessive stress acts on the lever 33. The lever 33 is rotated from the testing position to the connection starting position at the assembling site, and the male housing 20 is connected with the female housing 50, as shown in FIG. 6. Sufficient insertion of the female housing 50 into the receptacle 23 causes the cam pins 51 to pass through the entrances 37*a* of the cam grooves 37 and to unite with the cam pins 32 of the moving plate 28, as shown in FIG. 7. The lever 33 then is rotated from the connection starting position to the connection ending position. As a result, the female housing 50 and the moving plate 28 are pulled into the receptacle 23 by the engagement of the cam pins 32, 51 and the engaging areas 37*b* of the cam grooves 37. During this process, the tabs 12 are positioned by the positioning holes 29 of the moving plate 28 and enter the female housing 50.

The two housings 20, 50 are connected properly with each other when the lever 33 reaches the connection ending position, as shown in FIG. 8. At this time, the locks 52 of the female housing 50 engage the locking recesses 39 of the lever 33 to hold the housings 20, 50 at the connection ending position. Moreover, the operable portion 35 is within an insertion path of the female housing 50 into the receptacle 23 when the lever 33 is in the connection ending position (FIG. 8), but is laterally outside the receptacle 23 when the lever 33 is in the connection starting position (FIG. 1) or in the testing position (FIG. 3).

Rotation of the lever 33 at the testing position enables the moving plate 28 to be held at a position where all the tabs 12 project beyond the moving plate 28 and into the opening side of the receptacle 23. Thus, the electrical connection test is completed at one time despite different leading end positions for the tabs 12.

The rotating direction of the lever 33 at the time of the connecting operation is opposite from that of the lever 33 at the time of the electrical connection test. If the testing position had been set at an intermediate position along a course of the lever 33 between the connection starting position and the connection ending position, then the lever would be at a testing position intermediate the rotational course of the lever 33 when two housings are connected with each other. Thus, the lever could not be rotated continuously and efficiency would be reduced. However operability of the lever 33 is satisfactory according to this embodiment.

Further, the operable portion 35 of the lever 33 held at the testing position is offset from the opening side of the receptacle 23. Thus, the testing device can be inserted easily into the receptacle 23.

The invention is not limited to the above described and illustrated embodiment. For example, the following embodiments also are embraced by the technical scope of the invention as defined in the claims. Beside the following embodiments, various changes can be made without departing from the scope and spirit of the present invention as defined in the claims.

Although the lever is rotated in opposite directions at the time of the connecting operation and at the time of the test in the foregoing embodiment, the testing position may be set, for example, at an intermediate position of the rotation course of the lever from the connection starting position to the connection ending position and locks may be formed at positions where they are engageable with the locking recesses at this testing position. In such a case, the engaging areas of the cam grooves can be omitted and a range of rotation of the lever can be smaller.

Although the course of the lever during the rotation from the connection starting position to the connection ending position is at the opening side of the receptacle in the foregoing embodiment, the course of the lever during the connecting operation may be at a side opposite from the opening side of the receptacle.

The cam pin of the female housing and the cam pins of the moving plate are united and then engaged with one cam groove in the foregoing embodiment. However, two cam grooves may be formed in each arm portion 37 of the lever and the cam pin of the female housing and the cam pin of the moving plate may be engaged separately with the respective cam grooves.

The invention also is applicable to a lever-type connector in which only the movable plate has a cam pin and the female connector housing is interlockable with the movable plate so as to be drawn into the male connector housing by the operation of the lever.

The invention is also applicable to a lever-type connection with terminal fittings having tabs that project substantially the same length along the connecting direction, where the tabs need to be exposed from the movable plate for testing.

What is claimed is:

1. A lever-type connector, comprising:

a first housing with a receptacle having an opening side into which a second housing is fittable, terminal fittings being mounted in the first housing, the terminal fittings having tabs projecting into the receptacle;

a moving plate mounted in the receptacle for movement along a connecting direction, the moving plate having positioning holes for receiving the tabs of the terminal fittings, the moving plate having oppositely directed cam pins; and a lever rotatably supported on the first housing and formed with opposed cam grooves engageable with the cam pins, the lever being rotatable in a first direction to a testing position offset from the opening side of the receptacle such that the cam groove pulls the cam pin and the moving plate to a position where the tabs of all of the terminal fittings project beyond the moving plate and toward the opening side of the receptacle for testing, the lever further being rotatable in a second direction to a connection ending position where the cam groove pulls the cam pin, the moving plate and the second housing into the receptacle, the second direction being opposite from the first direction.

2. The lever-type connector of claim 1, further comprising lock means for releasably holding the lever at the testing position.

3. The lever-type connector of claim 1, wherein the tabs of the terminal fittings have tabs with leading ends at different positions along the connecting direction.

4. The lever-type connector of claim 1, wherein the lever in the connection ending position is aligned with the opening side of the receptacle.

5. The lever-type connector of claim 1, wherein the positioning holes have tapered entries for receiving the respective terminal fittings.

6. The lever-type connector of claim 1, wherein the second housing has a cam pin engageable with the cam groove of the lever.

7. The lever-type connector of claim 6, wherein the cam pin of the second housing is unitable with the cam pin of the movable plate for fitting in the same cam groove on the lever.

8. The lever-type connector of claim 1, wherein the lever is spaced from the opening side of the receptacle when the lever is in the testing position.

9. The lever-type connector of claim 1, wherein the lever abuts a receiving portion of the first housing in the testing position.

* * * * *